US006008445A

United States Patent [19]

Chen

[11] Patent Number: 6,008,445

[45] Date of Patent: Dec. 28, 1999

[54] ADJUSTMENT FOR DRUM SNARE

[76] Inventor: Chang-Hui Chen, 3 F1., No. 175, Sec. 2, An-Ho Rd., Taipei, Taiwan

[21] Appl. No.: 09/099,446

[22] Filed: Jun. 18, 1998

[51] Int. Cl.[6] ..... G10D 13/00; G10D 13/02

[52] U.S. Cl. ..... 84/415; 84/402; 84/410; 84/411 R

[58] Field of Search ..... 84/402, 410, 411 R, 84/415–417, 422.1, 422.2

[56] References Cited

U.S. PATENT DOCUMENTS 3,019,685 2/1962 Davis ..... 84/411

5,895,873 4/1999 Yanagisawa ..... 84/415

*Primary Examiner*—Robert E. Nappi
*Assistant Examiner*—Marlon T. Fletcher
*Attorney, Agent, or Firm*—Bacon & Thomas, PLLC

[57] ABSTRACT

A type of adjustment for snare drum, comprising a main unit to be fitted to the shell of a snare drum, an adjusting lever inside the main unit and a moving piece inside the main unit, which will move linearly in the main unit with the rotation of the adjusting rod in the main unit, for the purpose to adjust the snare tension; the entire adjustment composition is simplified, to save time and reduce costs in its assembling process, furthermore, due to its smooth operation, there will be no noise in the adjusting process.

6 Claims, 7 Drawing Sheets

ADJUSTMENT FOR DRUM SNARE

BACKGROUND OF THE INVENTION

The invention relates to a type of adjustment for drum snare, particularly one with simplified composition, time-saving assembly, reduced costs and smooth control.

Conventionally, a regular adjustment fitted on the shell of a drum for adjustment of the snare comprises a fixed unit fitted on the shell of a snare drum, and a clamp that clamps the snare with possible movement in the fixed unit, wherein said clamp involves a pull handle employing link gearing principle to achieve its linked movement, since the link gearing is more sophisticated, its production costs are increased accordingly, therefore, when the components are moving, their friction will be become serious, which results in noise and difficulty in operation, therefore:

In view of the above shortcomings, the inventor has presented an adjustment for the snare of a drum, comprising a main unit to be fitted on the shell of a drum, an adjusting rod installed in the main unit and a moving piece installed in the main unit, which will move linearly in the main unit with the rotation of said adjusting rod in the main unit, wherein said moving piece has a clamp to clamp the snare.

SUMMARY OF THE INVENTION

The primary objective of the invention is that, because of the simplified composition of the adjustment so presented, it will save time and reduce costs in its assembling process, meanwhile, there will be no noise during its adjusting process because of its smooth operation.

The detailed description and technical contents of the invention are accompanied by drawings.

DETAILED DESCRIPTION OF PREFERRED EMBODIMENT

Figure 1:
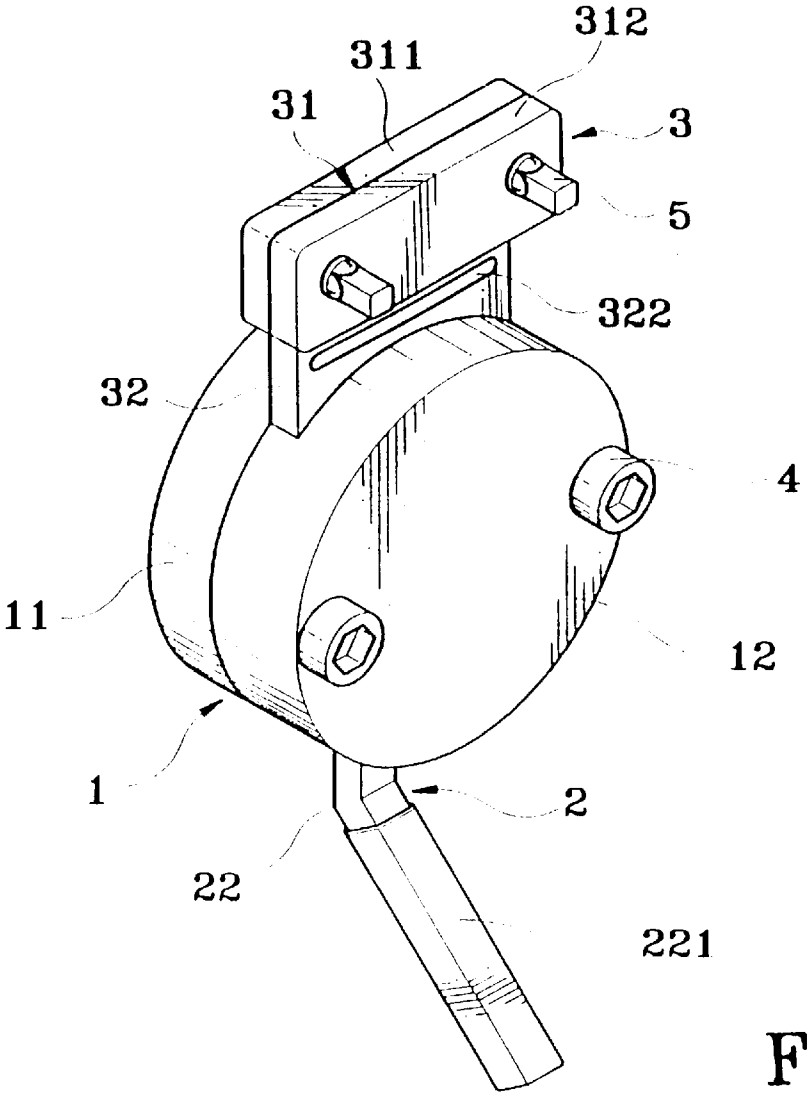
FIG. 1 is a perspective assembled view of the invention.
Figure 2:
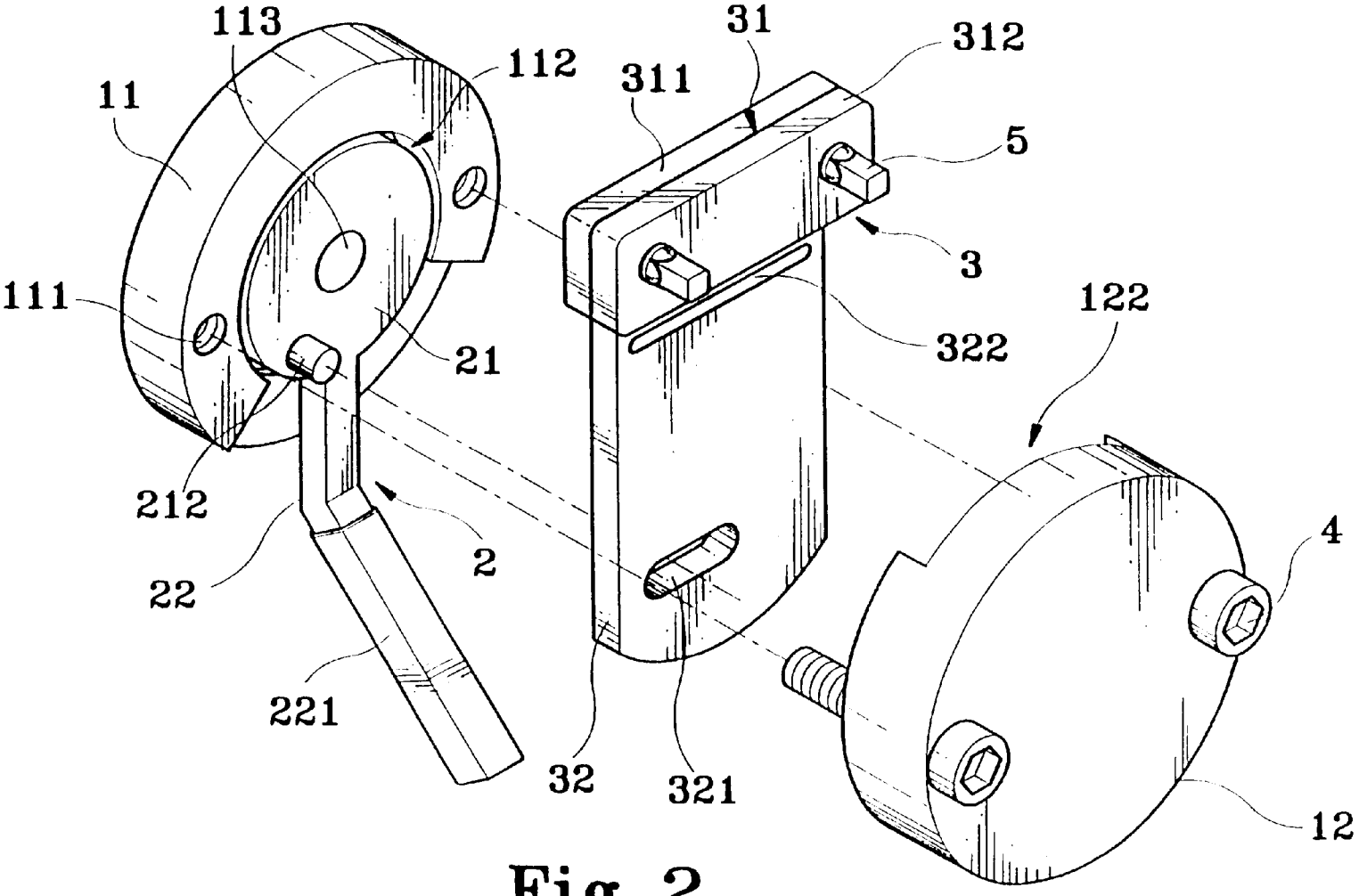
FIG. 2 is a partially exploded view of the invention
Figure 3:
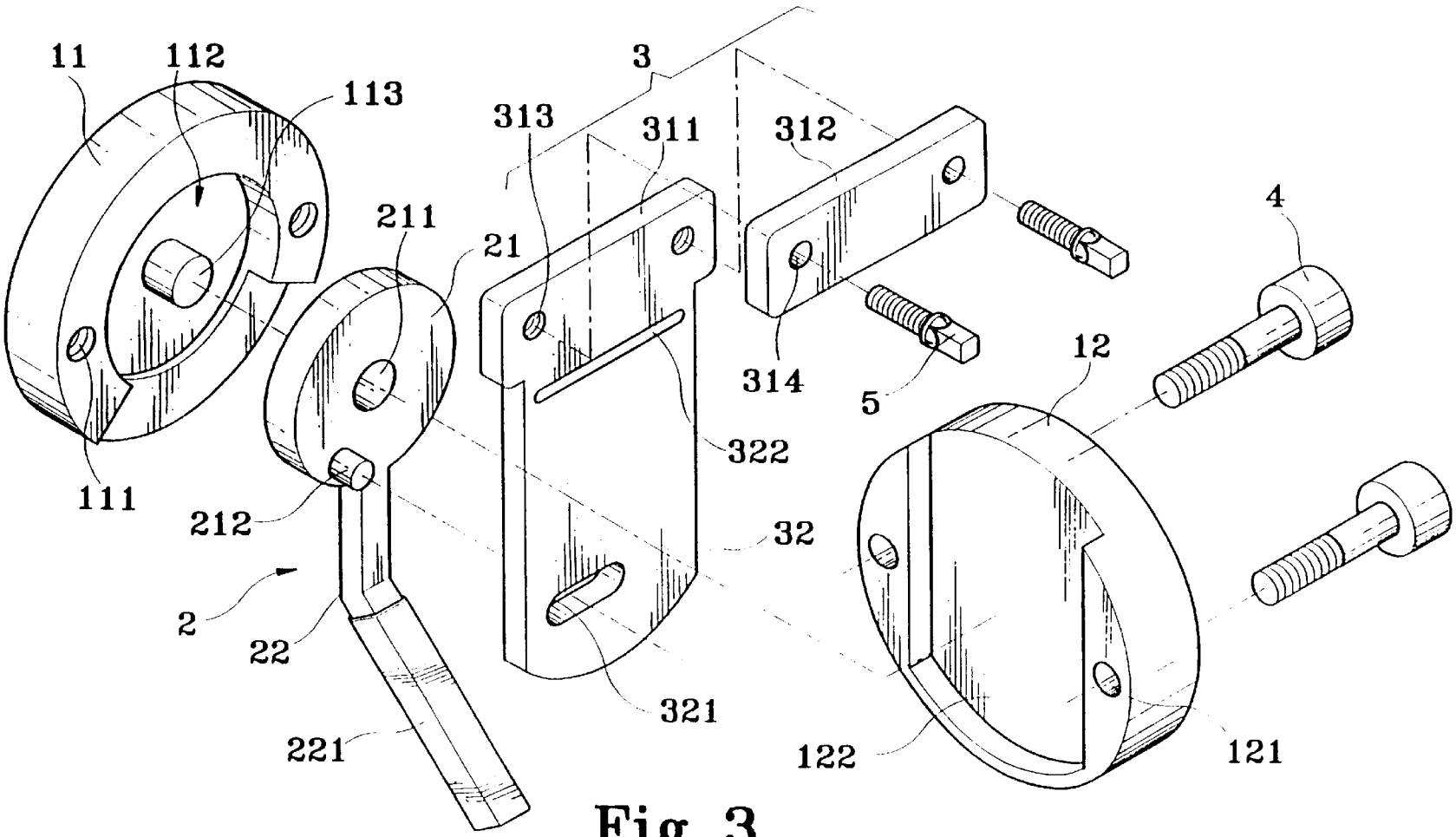
FIG. 3 is a fully exploded view of the invention.

Please refer to FIGS. 1, 2, 3 and 5, as shown in the drawings, the invention comprises a main unit, a tension rod 2 and a moving piece 3; the features of respective components and their relations with each other are described in details as below. The main unit 1 is composed of a bottom unit 11 and a top unit 12, at corresponding locations on the bottom unit 11 and the top unit 12 are joining holes 111, 121, a fixing component 4 goes through said joining holes 111, 121 to join them, meanwhile, said fixing component 4 goes further into the shell of a snare drum 6, thus the main unit 1 is fixed onto the snare drum 6. On said bottom unit 11 is a round accommodating depression 112, protruding from the center of said accommodating depression 112 is a shaft 113 to which said tension rod 2 can be mounted onto the accommodating depression 112; on the bottom unit 12 is a movement depression 122 to accommodate said moving piece 3.

Said tension rod 2 has a disc 21 that can be accommodated in said accommodation depression 112, and a pull handle 22 that extends radially from said disc 21, at the center of said disc 21 is a shaft hole 211 that can be inserted by said shaft 113, so that said disc 21 can be fitted in the accommodation depression 112, and turn in said accommodation depression 112; on one side of said disc 21 is a eccentric shaft 212, and the end of said pull handle 22 is the formation of a bend 221.

Figure 5A:
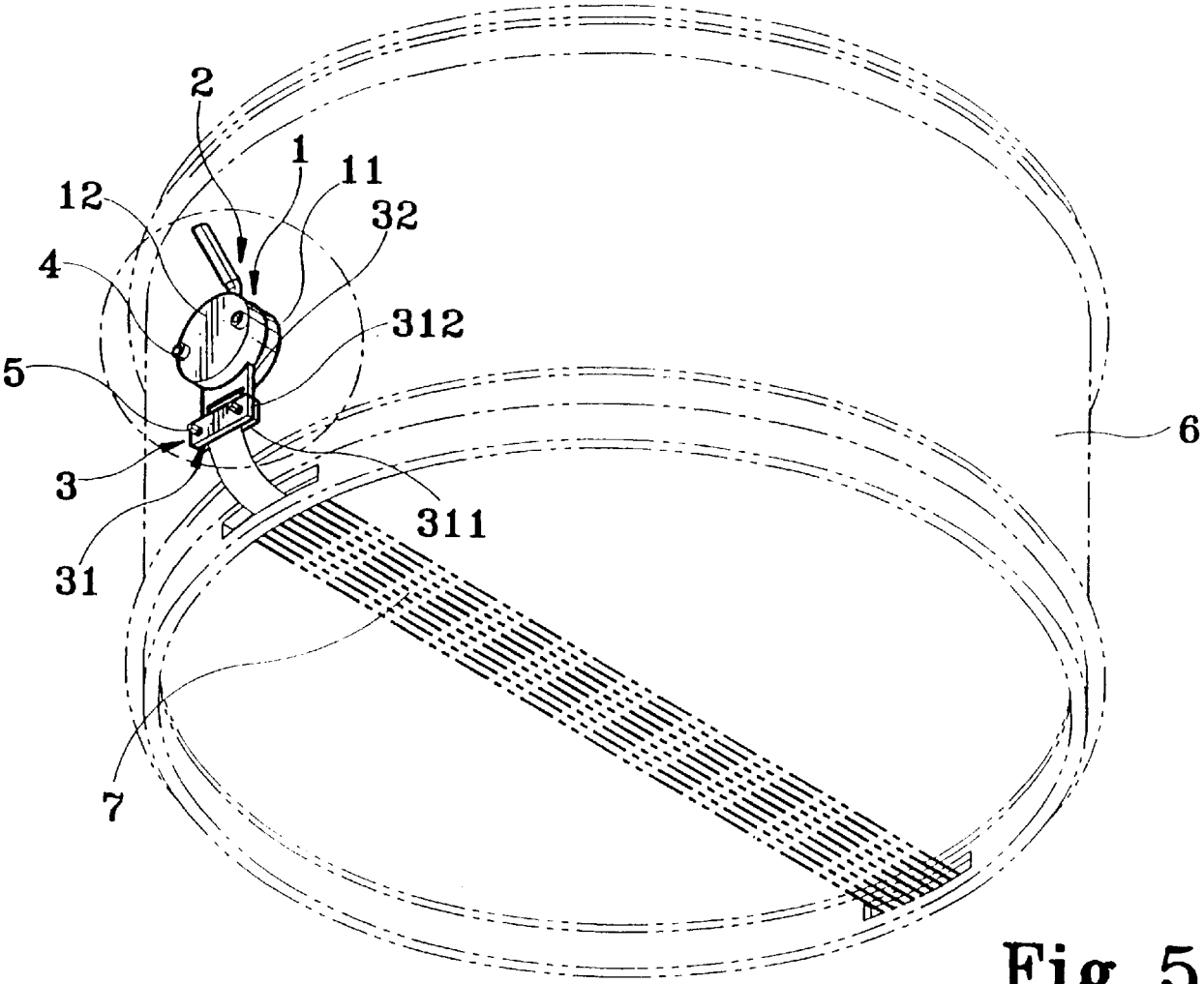
FIG. 5A is a view of the invention in application
Figure 5B:
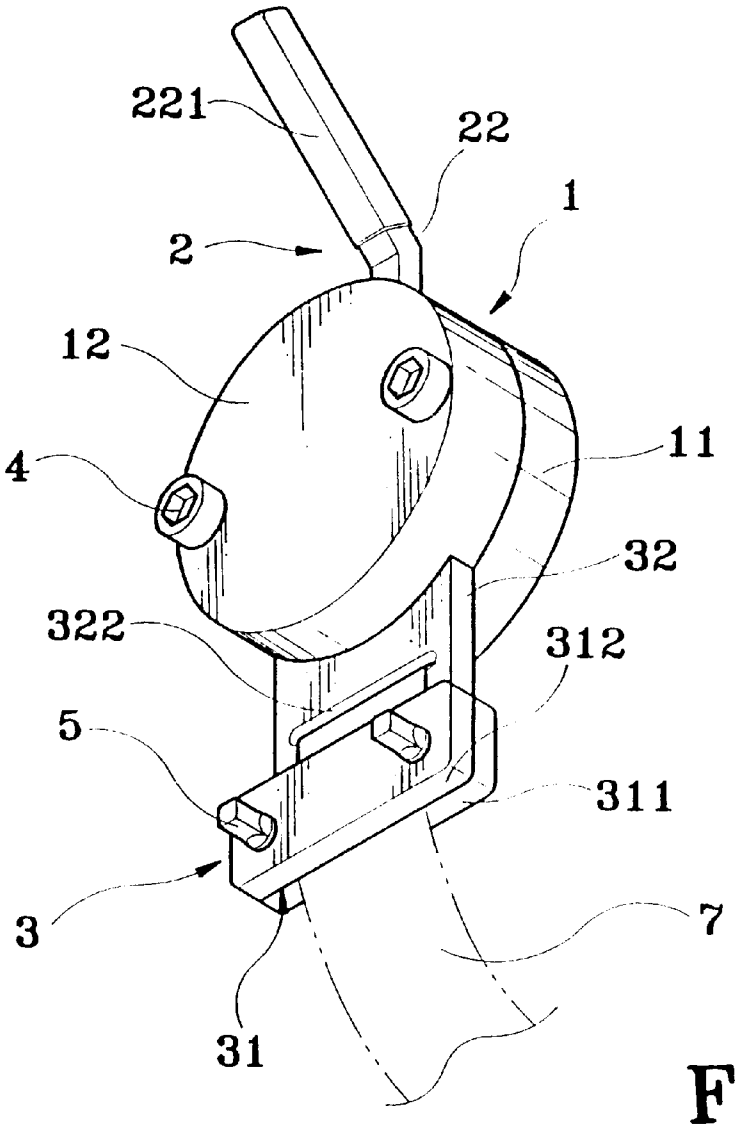
FIG. 5B is a close-up of FIG. 5A.

Said moving piece 3 has a clasp 31 to tighten the snare 7, and a driven part 32 in said movement depression 122, wherein said clamp 31 is composed of a fixed clamp 311 on the driven part 32 and a mobile clamp 312, wherein said fixed clamp 311 and moving clamp 312, on said fixed clamp 311 and moving clamp 312 have joining holes 313, 314, whereby an adjusting peg 5 can be pulled through said joining holes 313, 314 to clamp the snare 7; said driven part 32 has an elongated hole 321 which is inserted by the eccentric shaft 212 on one side of said disc 21, and an insert groove 322 to be inserted by the snare 7 coming out of the clamp 31, instead of being exposed (as shown in FIG. 5-1).

Figure 4A:
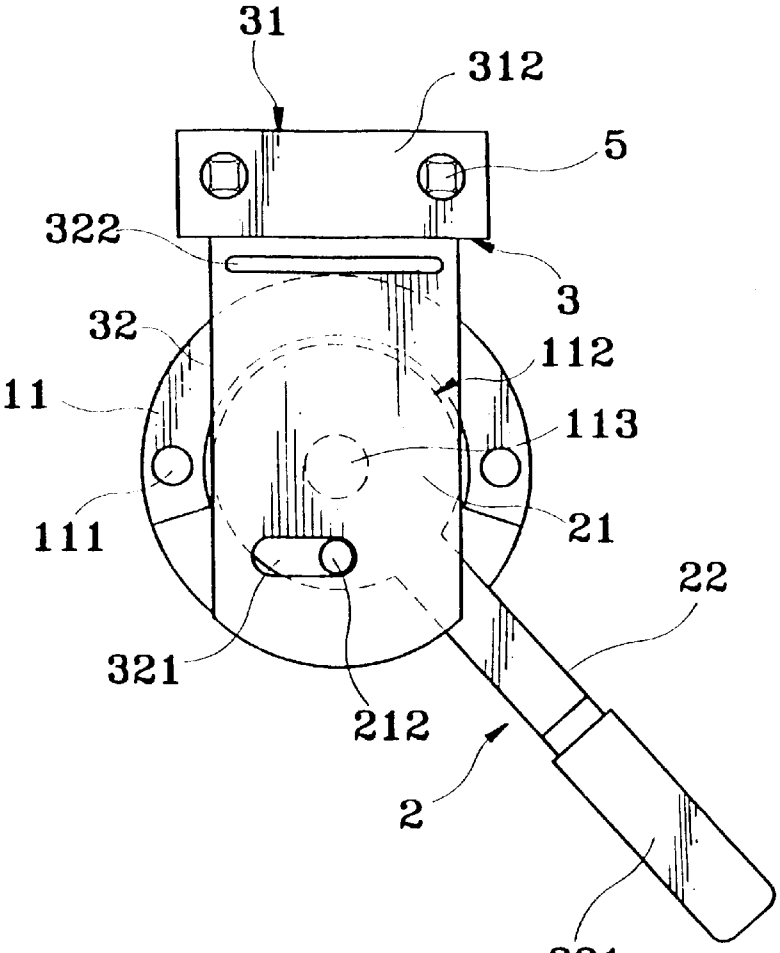
FIG. 4A is an embodiment view (1) of the invention.
Figure 4B:
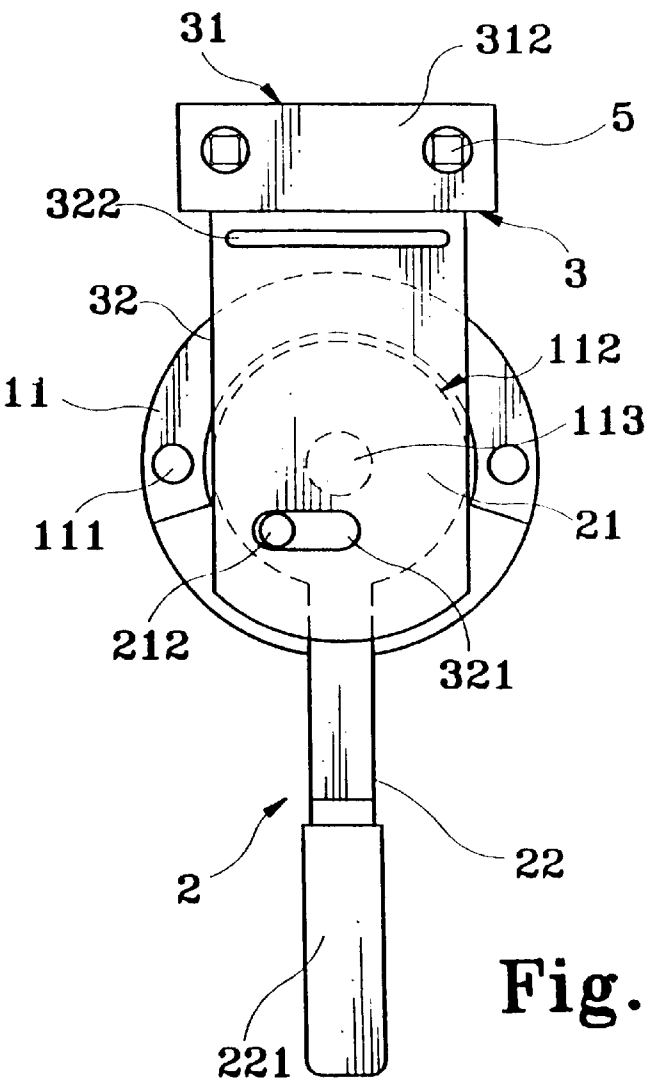
FIG. 4B is an embodiment view (2) of the invention.
Figure 4C:
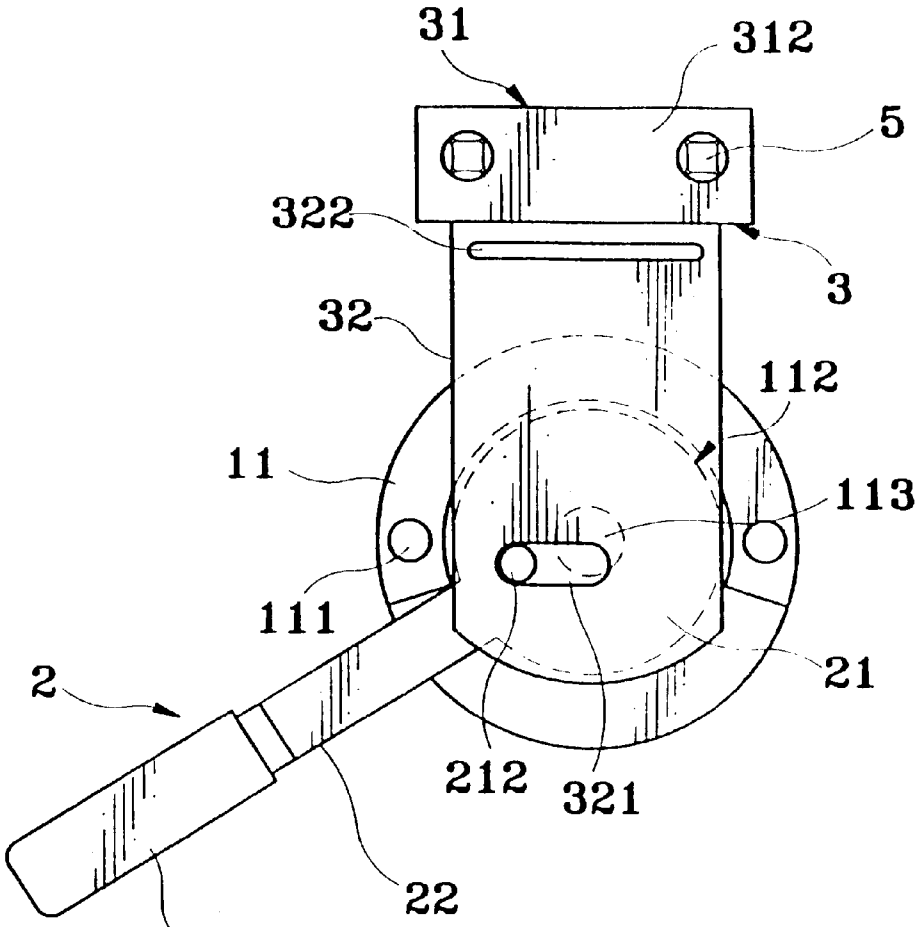
FIG. 4C is an embodiment view (3) of the invention.

Please refer to FIG. 5, as well as FIGS. 4A, 4B and 4C. The drawings illustrate how the tightness of the snare 7 is adjusted by the invention. It is known from the above that, the elongated hole 321 on the moving piece 3 is inserted by the eccentric shaft 212 of the tension rod 2, therefore, when the user pulls the bend 221 at the end of the pull handle 22 to drive the tension rod 2 to rotate, said eccentric shaft 212 will turn around the center of the disc 21, the transverse movement so caused will enable said eccentric shaft 212 to move in the elongated hole 321, while the resultant longitudinal movement will drive the moving piece 3 to move linearly in the main unit 1 (movement depression 122), which further converts the force pulling the snare 7 (the tension of the snare); since the construction of the invention is more simplified than conventional types, friction between components can be relatively reduced during the adjusting process, in other words, less friction means less noise, meanwhile, the operating process can be made smoother. In addition, because of fewer components, it saves time in the assembling process with reduced costs.

Summing up, with its applicability and originality, the above description, covering only the preferred embodiment of the subject matter should not be based to limit or restrict the subject claim, and that all equivalent variations and/or modifications deriving from the subject description with drawings herein shall reasonably be included in the intent of the subject claim.

What is claimed is:

1. A tension adjustment for the snare of a snare drum, said adjustment comprising:

a main unit for attachment to the shell of a snare drum, said main unit including a bottom unit and a top unit, said bottom unit having a round accommodation depression, and said top unit having a movement depression;

an adjusting rod having a disc that is disposed in the accommodation depression for rotation in said accommodation depression, a pull handle that extends radially from said disc, and an eccentric shaft extending from a side of said disc;

a moving piece having a clamp for clamping said snare and a driven part that is disposed in said movement depression, said driven part having an elongated hole within which said eccentric shaft is engaged, whereby when said adjusting rod is rotating in the main unit, said moving piece will move linearly in the movement depression to adjust the tension of the snare.

2. The adjustment for snare drum, as recited in claim 1, wherein said bottom unit and top unit are each provided with a plurality of corresponding joining holes, and a plurality of fixing components are engaged within the holes for fastening the units together.

3. The adjustment for snare drum, as recited in claim 1, wherein said pull handle includes a bent end.

4. The adjustment for snare drum, as recited in claim 1, wherein said accommodation depression includes a central shaft and the disc includes a shaft hole within which the central shaft is engaged.

5. The adjustment for snare drum, as recited in claim 1, wherein said clamp includes a fixed clamp that is secured on the driven part and a mobile clamp that is secured on the fixed clamp, wherein said fixed clamp and mobile clamp each have a plurality of corresponding joining holes through which a plurality of adjusting components maybe inserted to clamp the snare therebetween.

6. The adjustment for snare drum, as recited in claim 1, wherein said moving piece includes a groove for receiving the snare.

* * * * *